United States Patent [19]

Nippert

[11] Patent Number: 4,734,254

[45] Date of Patent: Mar. 29, 1988

[54] ENHANCED MACHINING ANNEAL RESISTANT COPPER ALLOY

[75] Inventor: Russell A. Nippert, Delaware, Ohio

[73] Assignee: The Nippert Company, Delaware, Ohio

[21] Appl. No.: 941,849

[22] Filed: Dec. 15, 1986

[51] Int. Cl.[4] ..... C22C 9/00

[52] U.S. Cl. ..... 420/497; 420/500

[58] Field of Search ..... 420/497, 500

[56] References Cited

U.S. PATENT DOCUMENTS

| | | | |
|---|---|---|---|
| 2,027,805 | 1/1936 | Burghoff et al. | 420/470 |
| 2,474,891 | 7/1949 | Davis | 310/180 |
| 3,872,913 | 3/1975 | Lohikoski | 164/474 |

FOREIGN PATENT DOCUMENTS

| | | | |
|---|---|---|---|
| 21183 | 7/1970 | Japan | 420/497 |

OTHER PUBLICATIONS

File 350: World Patents Index, English Abstract or Japanese Patent No. 70021183.

*Primary Examiner*—L. Dewayne Rutledge
*Assistant Examiner*—George Wyszomierski
*Attorney, Agent, or Firm*—Killworth, Gottman, Hagan & Schaeff

[57] ABSTRACT

An enhanced machining oxygen-free copper alloy is provided which contains at least 0.02% by weight silver and from 25 to 100 parts per million sulfur. The copper alloy is anneal resistant and has sufficient ductility to permit cold working.

4 Claims, No Drawings

ENHANCED MACHINING ANNEAL RESISTANT COPPER ALLOY

BACKGROUND OF THE INVENTION

This invention relates to copper-based alloys and, in particular, to an anneal resistant copper alloy having enhanced machining characteristics.

There are two basic types of copper and copper alloys commercially available today, namely, tough pitch (oxygen bearing) copper and oxygen free copper. Tough pitch coppers such as electrolytic tough pitch copper (C11000) and tough pitch copper containing silver (C114000) are known to have good machining characteristics. References to number designations for copper and copper alloys in this application will be to the (Copper Development Association Inc.) number designations. Such tough pitch copper alloys contain approximately 200 parts per million oxygen. The presence of oxygen makes such copper alloys unsuitable for severe cold working.

Oxygen free coppers, such as oxygen free copper (C10200) and oxygen free copper with silver (C10500), have enhanced ductility which permits severe cold working of the copper alloy. However, in some applications such as the production of commutators segments and in some punching operations, tough pitch copper must be used since the enhanced ductility of oxygen free copper makes it difficult to machine and further requires increased deburring after punching or machining operations.

Free machining copper alloys are commercially available. Two such alloys are tellurium bearing copper (C14500) and sulfur bearing copper (C14700). These alloys are commonly used in applications involving extensive machining such as in automatic screw machines or in operations where considerable metal removal is required. However, neither the tellurium bearing copper nor sulfur bearing copper alloys exhibit the anneal resistance of silver bearing copper alloys such as C11400 or C10500. Additionally, the free machining tellurium and sulfur bearing copper alloys do not have sufficient ductility to permit cold heading operations and/or severe bending of the alloy during fabrication.

Accordingly, the need still exists in the art for a copper alloy which has enhanced machining characteristics, good anneal resistance, and sufficient ductility to withstand cold heading operations.

SUMMARY OF THE INVENTION

The present invention meets that need by providing an oxygen free copper alloy which has enhanced machining properties, is anneal resistant, and has sufficient ductility to withstand cold heading and/or severe bending operations. The alloy of the present invention comprises copper, at least 0.02% by weight of silver, and from 25–100 parts per million of sulfur. Preferably, the alloy content of the silver is from about 0.02 to about 0.08%. Although greater amounts of silver can be added to the alloy, such additional amounts of silver do not contribute further to the anneal resistance of the alloy.

It has been found that the addition of small amounts of sulfur to the alloy in the range of from 25–100 parts per million, and preferably about 50 parts per million, enhances the machinability of the alloy. The sulfur content of the alloy is important as the machinability of the alloy varies widely with varying sulfur content.

Addition of sulfur in amounts of less than about 25 parts per million are not believed to sufficiently enhance the machinability of the alloy. Additionally, somewhat surprisingly, addition of larger amounts of sulfur above about 100 parts per million to the alloy also adversely affects the properties of the alloy.

Accordingly, it is an object of the present invention to provide an enhanced machining, anneal resistant copper-based alloy which has sufficent ductility to withstand cold heading operations. This, and other objects and advantages of the invention, will become apparent from the following detailed description and the accompanying claims.

DETAILED DESCRIPTION OF THE PREFERRED EMBODIMENTS

The enhanced machining copper alloy of the present invention includes at least 0.02% by weight of silver and from 25–100 parts per million of sulfur. The alloy is preferably made utilizing an oxygen free continuous upcasting process such as the process described in U.S. Pat. No. 3,872,913, the disclosure of which is hereby incorporated by reference. The continuous upcasting process permits the efficient production of the alloy.

Prior to the present invention, to applicant's knowledge, no copper alloy existed which had the proper combination of characteristics which would permit enhanced machining and yet possess sufficient ductility and formability to enable the alloy to be cold worked such as in cold heading operations. While existing tough pitch copper alloys such as C11000 and C114000 had good machining characteristics, the presence of oxygen in those alloys restricted their use and made them unsuitable for use in cold working operations. The alloy of the present invention has machining characteristics which are very similar to existing tough pitch copper alloys but has a much better ductility and formability for cold working operations than such tough pitch copper alloys. Additionally, the copper alloy of the present invention has an anneal resistance equivalent to prior existing silver-containing copper alloys. The enhanced machinability of the copper alloy of the present invention permits it to be utilized in cold working and cold heading operations, and also in certain punching and machining operations.

The alloy of the present invention can be used as a substitute for C114000 tough pitch copper alloy in the manufacture if punch bar type commutators. Because of its oxygen free nature and its ability to be cold worked, the copper alloy of the present invention is believed to be suited for use in molded shell style commutators and cold headed components. The enhanced machinability of the alloy of the present invention allows it to outperform such oxygen free copper alloys as C10500 in cold headed type products where machining is involved in the finishing operations. Finally, due to its enhanced machining capabilities and free punching qualities, the copper alloy of the present invention may be utilized to form products which are cold extruded or cold formed and later machined and/or roll threaded.

In order that the invention may be more readily understood, reference is made to the following examples, which are intended to illustrate the invention but are not to taken as limiting the scope thereof.

EXAMPLE 1

Several samples of copper alloys were tested to determine their machinability. Sample No. 1 was tough pitch silver bearing copper (C114000). Sample No. 2 was oxygen free, silver bearing copper (C10500). Sample No. 3 contained 0.04% silver and 100 parts per million sulfur. Sample No. 4 contained 0.04% silver and 50 parts per million sulfur. Sample No. 5 contained 0.04% silver and 200 parts per million sulfur.

All samples were prepared by drawing the materials to a 0.857 inch diameter and then annealing. The samples were then drawn to a 0.750 inch diameter in straight lengths. All materials were verified as to alloy content by use of a spectrograph.

The test samples were cut into 20 inch long bars for the machinability tests. The bars were machined on a LeBlond heavy duty 16 inch by 54 inch lathe equipped with a 30 horsepower D.C. variable speed drive motor. The tool material used for the tests were Teledyne Vasco grade T15 high speed steel SPG-422 inserts. The inserts were used with the following geometries: back rake 0°; side rake 5°; side cutting edge angle 15°; and cutting edgeware 15°; side relief 5°; and end relief 5°. The tests were performed until all work material was used. This produced a minimum tool life of approximately 32 minutes. Cutting speed for the tests was 500 fpm. The feed was 0.010 ipr and the depth of cut was 0.050 inches. No cutting fluid was used.

Table I below indicates the difference in wear caused by each individual sample as measured in differences in tool life. All results were reported at a constant wear of 0.008 inches localized wear. In general, the longer the tool life, the better the machinability of the alloy. However, the oxygen free Sample No. 2 exhibited a serious chip control problem. When machined, Sample No. 2 produced a connected chip which would cause a very serious problem in a production situation. This difficulty in machining is typical of prior oxygen free copper alloys.

TABLE I

| Sample No. | Tool life (minutes) | % Difference in tool life |
|---|---|---|
| 1 | 30 | — |
| 4 | 28 | 7 |
| 2 | 26 | 15 |
| 3 | 26 | 15 |
| 5 | 25 | 20 |

Tool wear versus time was also measured during the tests, and the results are reported in Table II below.

TABLE II

| Sample No. | Tool life (minutes) | Wear (inches) Uniform | Localized |
|---|---|---|---|
| 1 | 1.5 | 0.001 | 0.001 |
| 1 | 2.9 | 0.001 | 0.002 |
| 1 | 8.7 | 0.003 | 0.003 |
| 1 | 16.3 | 0.004 | 0.006 |
| 1 | 25.2 | 0.007 | 0.008 |
| 1 | 34.0 | 0.008 | 0.010 |
| 2 | 8.7 | 0.0005 | 0.0005 |
| 2 | 17.4 | 0.002 | 0.002 |
| 2 | 25.0 | 0.004 | 0.006 |
| 2 | 33.6 | 0.005 | 0.010 |
| 3 | 1.5 | 0.0005 | 0.0005 |
| 3 | 8.9 | 0.002 | 0.002 |
| 3 | 18.1 | 0.005 | 0.006 |
| 3 | 26.1 | 0.008 | 0.008 |
| 3 | 37.2 | 0.010 | 0.012 |
| 4 | 1.5 | 0.0005 | 0.0005 |

TABLE II-continued

| Sample No. | Tool life (minutes) | Wear (inches) Uniform | Localized |
|---|---|---|---|
| 4 | 3.3 | 0.001 | 0.001 |
| 4 | 5.0 | 0.001 | 0.001 |
| 4 | 6.7 | 0.001 | 0.001 |
| 4 | 7.5 | 0.001 | 0.001 |
| 4 | 9.0 | 0.001 | 0.001 |
| 4 | 16.0 | 0.003 | 0.004 |
| 4 | 20.3 | 0.004 | 0.006 |
| 4 | 24.7 | 0.004 | 0.008 |
| 4 | 32.4 | 0.006 | 0.008 |
| 5 | 8.9 | 0.002 | 0.002 |
| 5 | 17.8 | 0.004 | 0.006 |
| 5 | 26.8 | 0.008 | 0.008 |
| 5 | 35.7 | 0.009 | 0.010 |

The results in Tables I and II show that Sample Nos. 3 and 4, which represent copper alloys within the scope of the invention, produced a tool life which was superior to the C10500 oxygen free silver bearing copper alloy and almost as good as the C114000 tough pitch silver bearing copper alloy. Additionally, although oxygen-free they did not have the connected chip control problem associated with Sample No. 2, the prior art oxygen free alloy.

EXAMPLE 2

The cold working capability of the five copper alloy samples reported in Example 1 were tested. The cold heading sequence to which all five samples were subjected was as follows. All samples had an initial wire diameter of 0.210 inches. All samples were cold headed to produce a head diameter on each wire of 0.512 inches. This represents an increase in area of 5.9 times, or 2.22 upsets of the wire (where one upset is a diameter equal to length). Sample Nos. 1, 3 and 5 all exhibited a lack of ductility and showed a high degree of splits and bursts on the vertical side of the 0.512 inch head diameter. Sample Nos. 2 and 4 both exhibited satisfactory ductility and exhibited no splits or bursts. The test showed that a copper alloy within the scope of the present invention (Sample No. 4) had ductility which compares very favorably with oxygen free silver bearing copper (C10500) (Sample No. 1).

EXAMPLE 3

Three of the alloys from Example 1 were subjected to a hole punching test. One characteristic of oxygen bearing copper alloys is that they punch very cleanly in punching applications. This is primarily due to the relatively low ductility of oxygen containing alloys and the manner in which the oxygen present causes the material to shear and break.

The hole punching test was conducted using samples prepared as in Example 1. These samples were subsequently flattened to 0.225 inches in thickness. A punch and die setup with a punch having a 0.300 inch diameter was used to punch holes in all three strips of the alloys. The resulting slug from the punched hole was retained and identified. The results of this test are shown in Table III below.

TABLE III

| Sample No. | $A_i$ | $A_f$ | Aavg | Shear |
|---|---|---|---|---|
| 2 | 0.132 | 0.110 | 0.12 | 52.6% |
| 1 | 0.084 | 0.048 | 0.066 | 29.4% |
| 4 | 0.126 | 0.092 | 0.109 | 47.4% |

Dimension A in Table III represents the amount of shear which resulted from the punching operation. As can be seen, the tough pitch silver bearing alloy (Sample No. 1) had the smallest percentage of shear corresponding to the largest break percentage. An alloy of the present invention was next best (Sample No. 4) and the oxygen free silver bearing copper alloy was worst (Sample No. 2). The test illustrates that the oxygen free copper alloy of the present invention punches cleaner than prior oxygen free copper bearing alloys.

EXAMPLE 4

Samples taken from the alloys flattened for use in the hole punching test of Example 3 were subjected to a heat resistance test. The Rockwell F hardness of each sample was determined before and after heating. In Test No. 1, the samples were heated to 500° F. for one hour. In Test No. 2, the samples were heated to 550° F. for one hour. The results are shown in Table IV below.

TABLE IV

| Test No. | Sample No. | Rockwell F hardness Before | After |
|---|---|---|---|
| 1 | 1 | 86/86 | 88/88 |
| | 2 | 91/92 | 93/93 |
| | 4 | 94/95 | 95/95 |
| 2 | 1 | 93/94 | 93/95 |
| | 2 | 94/96 | 94/96 |
| | 4 | 91/92 | 92/92 |

As can be seen, all three samples performed substantially as well with respect to their resistance to annealing. A sample which was not anneal resistant would have exhibited a lower Rockwell F hardness after heating.

Having described the invention in detail and by reference to preferred embodiments thereof, it will be apparent that modifications and variations are possible without departing from the scope of the invention which is defined in the appended claims.

What is claimed is:

1. An enhanced machining, anneal resistant, oxygen-free, copper-based alloy consisting essentially of at least 0.02% by weight silver, from 25 to 100 parts per million sulfur, and the balance copper.

2. The alloy of claim 1 wherein said silver content is from 0.02 to 0.08% by weight.

3. The alloy of claim 1 wherein said sulfur content is 50 parts per million.

4. An enhanced machining, anneal resistant, oxygen-free, copper-based alloy consisting essentially of 0.04% by weight silver, 50 parts per million sulfur, and the balance copper.

* * * * *